United States Patent [19]

Jones

[11] Patent Number: 4,489,920

[45] Date of Patent: Dec. 25, 1984

[54] HOT ZONE CHAMBER WALL ARRANGEMENT FOR USE IN VACUUM FURNACES

[76] Inventor: William R. Jones, 244 Hampshire Dr., Chalfont, Pa. 18914

[21] Appl. No.: 496,636

[22] Filed: May 20, 1983

[51] Int. Cl.[3] ..... F23M 5/00

[52] U.S. Cl. ..... 266/283; 266/286; 266/208

[58] Field of Search ..... 266/283, 286, 207, 208, 266/280; 373/130, 112, 137

[56] References Cited

U.S. PATENT DOCUMENTS

| | | | |
|---|---|---|---|
| 2,829,877 | 4/1958 | Davis, Jr. | 266/283 |
| 3,330,546 | 7/1967 | Bryan | 266/286 |
| 3,636,872 | 1/1972 | Forcier | 266/286 |
| 4,246,852 | 1/1981 | Werych | 266/283 |
| 4,259,538 | 3/1981 | Jones | 373/130 |

*Primary Examiner*—L. Dewayne Rutledge
*Assistant Examiner*—S. Kastler
*Attorney, Agent, or Firm*—William E. Cleaver

[57] ABSTRACT

The present invention includes a plurality of ceramic oxide wall panels which are defined by a thickness dimension, depth dimension, and width dimension. The ceramic oxide panels are beveled along their width sides so that when they are held together along their width sides, they form a closed plane, that is a polygon or a substantial circle configuration. At each abutment position of two adjacent wall panels, there is formed an abutment angle. In addition a plurality of overlap support panels of ceramic oxide is employed and each is formed to have an angle which fits over an associated one of said abutment angles. Each overlap support panel is secured to, and partially overlays, two abutting wall panels, thus providing support for said two adjacent abutting wall panels. In a preferred embodiment each overlap support panel abuts two adjacent support panels. In addition, at each location where two overlap support panels are in abutment, there is located a second support member arranged to bridge the abutting edges of the adjacent overlap support panels. Further, in addition, there is a ring member which is located to lie around the periphery of the package of panels coming in touch with the apexes of the said angles of the overlap support panels and coming in touch with the outer surfaces of the second support members.

6 Claims, 5 Drawing Figures

HOT ZONE CHAMBER WALL ARRANGEMENT FOR USE IN VACUUM FURNACES

BACKGROUND

In vacuum furnace devices it is customary to have a hot zone within which the workpiece that is being "treated" is located. It is also customary in the fabrication of such vacuum furnaces that the hot zone be designed to provide an outside wall of heat insulating material so that the heat within the hot zone can be reasonably contained. Such walls of heat insulation material have more recently been made from graphite felt and graphite sheet with the later material being the inside layer of the composite heat insulating wall. Heat insulation walls formed of graphite felt and graphite sheet have been satisfactory for the most part, but such arrangements nonetheless do have infirmities. For instance, the initial cost of walls of graphite felt with graphite sheet inside layers is high. Secondly, graphite, if heated and exposed to oxygen, will burn. Thirdly, graphite interacts with materials which evaporate from various workpieces, or the graphite material cracks because of the difference in coefficients of temperature between built-up material and the basic graphite per se.

The present system uses ceramic oxide insulating panels, which material does not readily react chemically with materials from a workpiece. In addition, these ceramic oxide panels are capable of standing very high temperatures and temperature cycles without breaking or cracking and, thirdly, the cost of the ceramic oxide material is relatively low when compared with the cost of graphite.

SUMMARY

The present device, in a preferred embodiment, employs a plurality of wall panels made of a ceramic oxide, such as alumina oxide, zirconia oxide, magnesia oxide, beryllium oxide, or the like. The panels, which are in the range of $\frac{1}{4}$ to $\frac{3}{4}$ of an inch thick are beveled along that thickness. These panels are fitted together along their beveled edges in a string that closes on itself, i.e., forms a closed plane, or a polygon, or a substantially circular configuration. Around the outside, or periphery, of such a closed plane, there is located a plurality of overlap support panels, each of which has a concave type angle that fits over the outside angle formed by the abutting beveled edges of the wall panels. In a preferred embodiment, the support panels are also made of ceramic oxide. In said preferred embodiment, a second support member is employed to bridge each occasion that there are abutting edges of two overlap support panels. The wall panels and support panels have apertures formed therein, which permit molybdenum rods to pass therethrough. In addition a stainless steel ring is disposed around the panel package and the panels are removably secured thereto by virtue of the molybdenum rods. The molybdenum rods also serve to support the heating element of the hot zone in the vacuum furnace. In addition, other apertures are formed in the panels which permit nozzles to be located therein, which permit inert gas to be loaded into the hot zone chamber during a quenching or a cooling operation.

The features and objects of the present invention will be better understood in accordance with the following description taken in conjunction with the drawings wherein.

Figure 1:
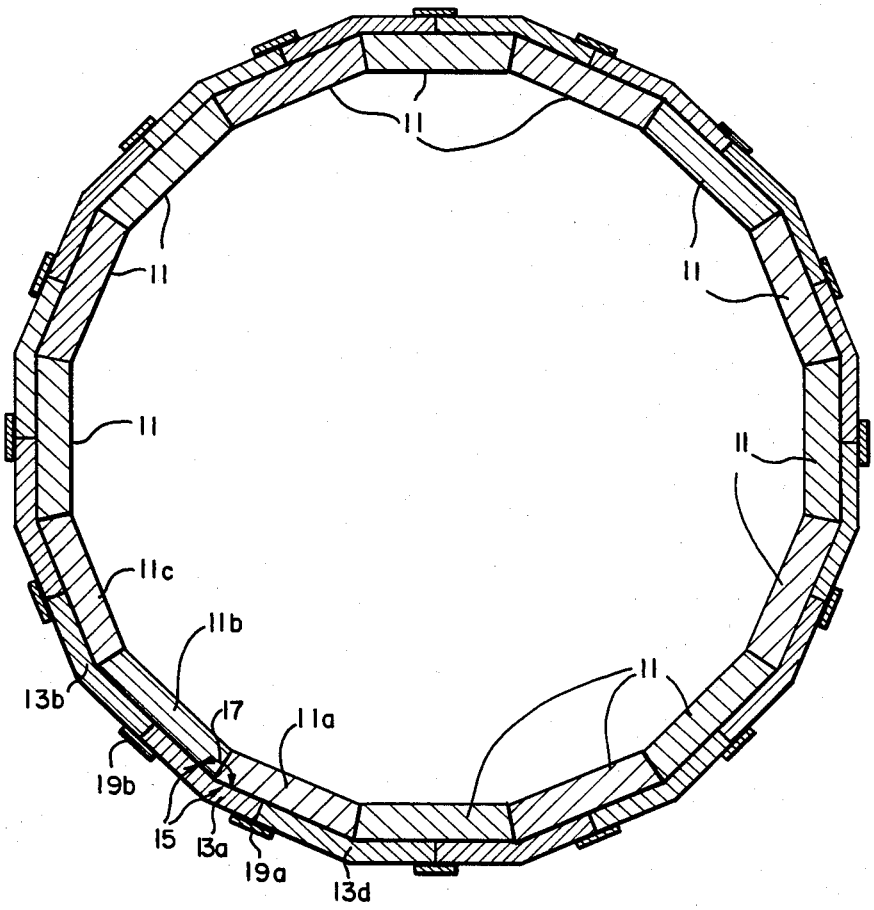
FIG. 1 is an end view schematic depicting the arrangement of the ceramic wall panels, the overlap support panels and the second support members which together form the insulating wall of the hot zone.

Examine FIG. 1 which shows an end view of the ceramic oxide panels. In FIG. 1 it can be noted that there are some sixteen ceramic oxide wall panels 11 which are fitted together to form a closed plane, or a polygon, or a substantially circular configuration. In a preferred embodiment, the wall panels 11 are formed of alumina fibers. The alumina fibers in the ceramic wall panels 11 are originally held together with a binder and before the panels are used to make up the insulating wall of a hot zone chamber, the binder is literally burned off so that there will be no chemical reaction between the binder and any materials which might evaporate or be dislodged from a workpiece within the hot zone chamber. Accordingly, when the panels 11 are employed for their intended use, in the preferred embodiment, they are in the form of alumina fibers. It should be understood that other forms of ceramic oxide could be used, such as zirconia oxide, magnesia oxide, beryllium oxide, and the like. The prerequisite is that such ceramic oxides must be able to withstand temperatures up to 3,000° F. without cracking, or breaking, or disintegrating and such ceramic oxides must be able to operate in such a temperature range without interacting chemically with other materials.

Figure 2:
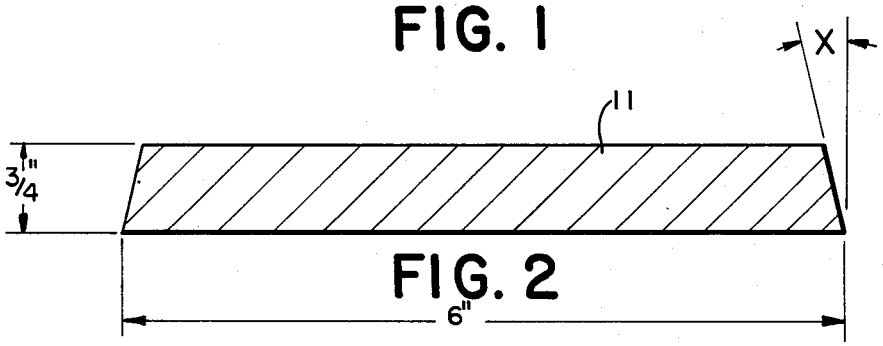
FIG. 2 is an end view of the wall panels or the inside panels of the polygon shown in FIG. 1.

The wall panels, in a preferred embodiment, have a thickness dimension which can be seen in FIG. 2 as $\frac{3}{4}$ of an inch. The wall panels have a width dimension which can be seen in FIG. 2 as 6 inches and these panels have a depth dimension which runs perpendicular to the drawing and there is no depth dimension shown in the drawing. It should be understood that the depth dimension, in a preferred embodiment, is in the range of 10" to 12" depending on the size of the vacuum furnace. As also can be gleaned from FIGS. 1 and 2, the edges of the wall panels, along the depth dimension, are beveled, i.e. the thickness of each wall panel is beveled. The angle of the bevel is shown as angle X and it can vary in size depending upon the number of panels that are to be used and the size of the polygon to be formed.

As can be seen in FIG. 1, when the wall panels are fitted together at their beveled edges, they form a string of panels which closes on itself. To say it another way the panels form a closed plane or polygon. When wall panels are fitted together at their beveled edges, they form an angle whose apex goes to the outside of the polygon, or to the outside of the heat insulation layered wall. The design of the wall of insulating panels is such that at the abutting edges of two wall panels, there is located a support panel which is formed to have an angle that will fit over the apex angle formed at the beveled edges of abutting wall panels. This arrangement can be seen in FIG. 1 and the concave angle can be seen in FIG. 3.

Figure 3:
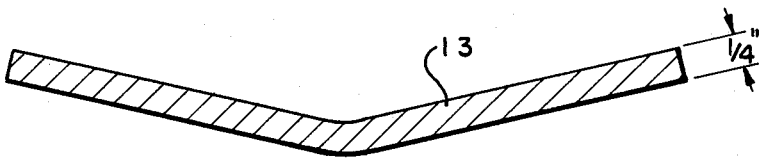
FIG. 3 is an end view of a first support panel as shown in FIG. 1.

In FIG. 1 it can be determined that the support panel 13A has an angle 15 which fits the apex angle 17 formed by the beveled abutting edges of the panels 11*a* and 11*b*. It also can be seen in FIG. 1 that the angle of the supporting panel 13*b* fits the angle formed by the abutting beveled edges of the wall panels 11*b* and 11*c*. This pattern is followed around the periphery of the closed plane made up of the wall panels 11 so that at each of the locations where a wall panel abuts an adjacent wall panel, there is a support panel overlaping those abutting edges. FIG. 3 depicts an overlap support panel. In FIG. 3 it can be seen that the overlap support panel edges are not beveled, and that its centermost portion has the concave angle which fits over the apex angle formed by the beveled edges of abutting wall members. The edges, along the depth dimension of the overlap support panel, are not beveled and do not have to be beveled because the angular configuration necessary to make one overlap support panel fit evenly with an abutting overlap support panel is provided for by having the middle of the overlap support panel in such an angular configuration.

Figure 4:
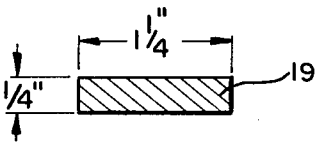
FIG. 4 is an end view of a second support member as shown in FIG. 1.

It can be seen in FIG. 1 that at each location where a support panels abuts an adjacent overlap support panel there is located a second support member such as members 19A and 19B. The support member 19A is located over the abutting edges of the overlap support panels 13A and 13D. In a similar fashion, the support member 19B is located over the abutting edges of the overlap support panels 13A and 13B. This pattern is followed around the periphery of the package and, in particular, the second support members come in contact with the abutting edges of adjacent support panels. FIG. 4 shows a detailed enlargement of a second overlap support member used in a preferred embodiment. In FIG. 4, it can be seen the thickness is a quarter of an inch while the depth is 1¼ inches, and, of course, the depth would be similar to the depth of whatever support panels were being employed.

Figure 5:
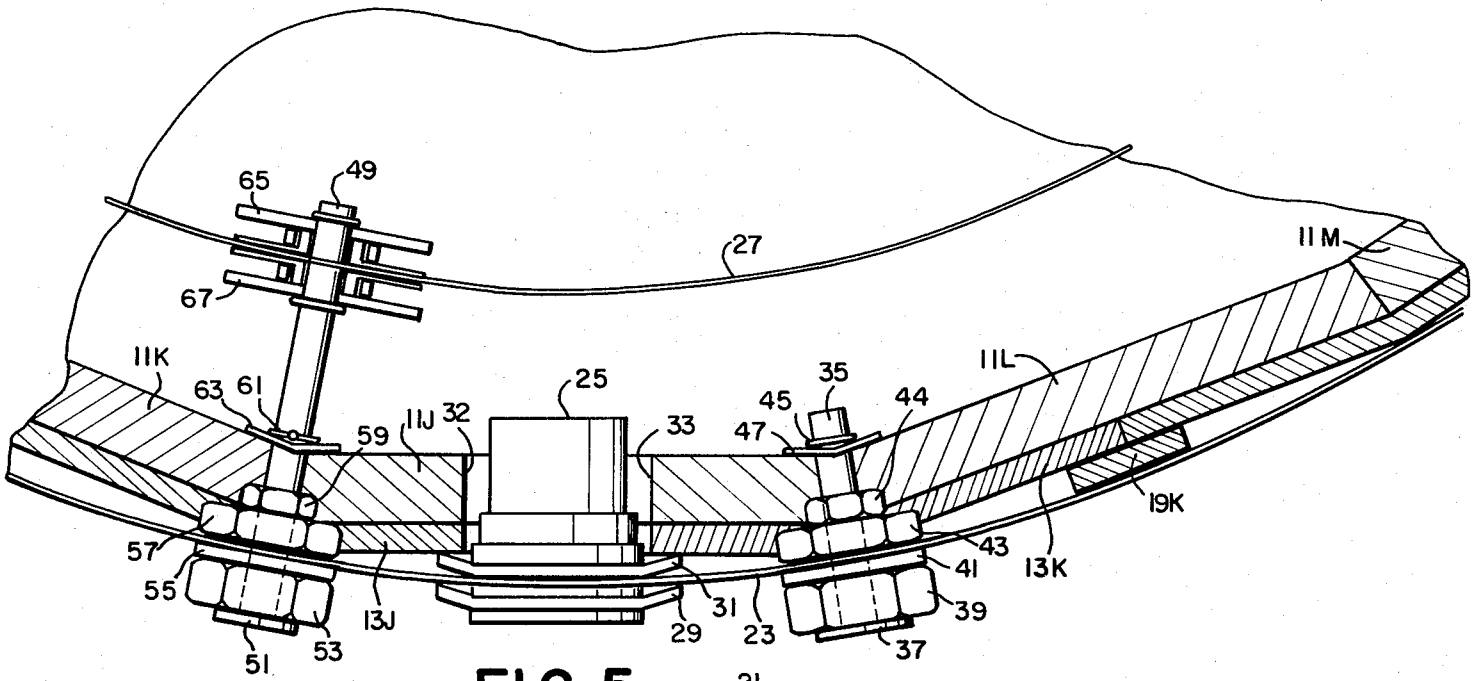
FIG. 5 shows a portion of the hot zone depicting the arrangement of the panels and the metal ring along with the arrangement of the molybdenum rods and the arrangement of a gas nozzle.

FIG. 5 shows a more complete arrangement of the elements within a section of the hot zone chamber using the ceramic panel insulation wall. In FIG. 5 there are shown the wall members, or portions thereof, 11K, 11J, 11L, and 11M. Further, as can be seen in FIG. 5, the first support panel 13J overlaps the abutting edges of the wall panels 11K and 11J while the support panel 13K overlays the abutting edges of the wall panels 11J and 11L. Also as can be seen in FIG. 5, the support panel 13L overlays the abutting edges of the wall panels 11L and 11M. Further, as can be seen in FIG. 5, the second support member 19K overlays the abutting edges of the support panels 13L and 13K. The hot zone chamber, of the vacuum furnace, has to accommodate the problems arising with cooling the workpiece or quenching the workpiece. The way in which that is done in a vacuum furnace system with which the present invention is shown in FIG. 5, is to provide a plenum 21 whose bottom-most wall is a stainless steel ring 23. When inert gas is to passed into the hot zone chamber to cool a workpiece, the gas is passed through a nozzle 25, on either side of segments the heating element 27, (which has substantial separations between the segments of the heating element) into the middle of the hot zone chamber to come in contact with the workpiece. It should be understood that there are many nozzles such as nozzle 25. The nozzle 25 is shown in a position that a second support member 19 might be shown. In point of fact, there are normally second support members on either side of the nozzle location. As can be gleaned from FIG. 5, upon inspection, the nozzle 25 is secured to the stainless steel ring 23 by a pair of nut members 29 and 31. There is a matching aperture cut through the wall panel 11J and through the support panels 13K and 13J as depicted by the dashed lines 32 and 33. That aperture permits the nozzle to be located into the hot zone chamber so that inert gas can be passed therethrough. The nozzles are not located at every position that a second support member might be located, but by virtue of the shape of the nut 31, the spacing between the support panel and the stainless steel ring is maintained uniform with respect to the spacing that is maintained by the second support members such as support member 19K. At a location where two wall members are in abutment, matching apertures are formed through those two wall members, and an aperture is formed through the center of the support member. This can be seen by examining the arrangement of the molybdenum short rod 35 which is shown passing through the matching apertures in the wall members 11L and 11J as well as through the aperture in the supporting panel 13K. The molybdenum rod 35 has a flange 37 thereon and the upper portion of the rod 35 toward the flange 37 is threaded. On the threaded portion of the rod, there is located a nut 39, a washer 41, and a nut 43. The nuts 39 and 43 lie on opposite sides of the ring 23 and enable the rod 35 to be "pulled up" tight so that the cotter pin 45 pulls against the bracket 47 to hold the wall panels 11J and 11L, as well as the support panel 13K in a firm position with respect to the stainless steel ring 23. The bracket 47 is also made of molybdenum, as is the pin 45.

In the event a wall panel must be removed for replacement or repair, the nuts are loosened and the cotter pin is removed to permit the wall panels to be replaced or repaired on an individual basis.

As can be further seen in FIG. 5, at each location where the wall panels come in abutment, there is not necessarily a bracket, or holding arrangement, such as just discussed with respect to the short rod 35 and its cooperating members. As can be seen to the left of the drawing in FIG. 5, there is a long molybdenum rod 49 which also has a flange 51 thereon. The long molybdenum rod 49 is threaded at the flange end to accommodate the nut 53, the washer 55, the nut 57 and the nut 59. The nuts 53, 57, 59 can be and are threaded to pull up the cotter pin 61 and hence the bracket 63 against the wall panels 11J and 11K, as well as against the supporting panel 13J to hold those panels in a very firm arrangement. It should be understood that the apertures which are cut through the panels 11J and 11K are not for the entire depth dimension, but are only large enough to accommodate the rods so that there still is a substantial part of the beveled edge of one panel which is an actual abutment with its adjacent beveled edge of another panel.

The arrangement of the shields 65 and 67, as well as the separators therebetween, is explained in my U.S. Pat. No. 4,259,538 and no further description thereof is necessary in this discussion.

The use of the ceramic oxide panels to provide an insulating wall for a hot zone provides a number of advantages. In the first instance, the ceramic oxide panels are less expensive than the traditional layers of graphite and graphfoil. Secondly, the ceramic oxide panels do not function such as to provide chemical reactions with materials that are dislodged or evaporated from the workpiece. One of the problems with using graphite walls or graphfoil layers, as explained earlier, is that graphite, when operating in high temperatures, has a tendency itself to evaporate and has a tendency to interact with other materials, to provide undesirable results. A third advantage in using ceramic oxide panels is that if for some reason when the system was being purged or the workpiece being quenched, oxygen were to get into the vacuum furnace, no damage would result to the walls. If oxide were to get into the vacuum furnace during a purge, or at some point in time when the temperatures are still high therein, the graphite walls and the graphfoil would literally burn and there would be a substantial amount of damage done to the walls of the hot zone chamber which, of course, would have to be repaired. In point of fact, the present hot zone could be run in an oxygen atmosphere without damaging the insulating walls.

In addition the provision of the overlap panels enhances the strength of the chamber while representing an easy assembly. Since all panels are easily removed, repairs can be readily achieved.

I claim:

1. Hot zone chamber wall arrangement for use with a vacuum furnace, which vacuum furnace has a heating means comprising in combination: a plurality of chamber wall panels of ceramic oxide material, each of said panels having a thickness dimension, a depth dimension, and a width dimension, and each panel disposed to have an inside surface defined by its depth and width dimension and each further formed to have a width dimension which is at least one and one-half times larger than its depth dimension, each of said panels formed to be bevelled along its thickness dimension, each of said panels further formed and disposed to come in contact along its depth dimension with an adjacent wall panel whereby each two adjacent wall panels in abutment form an abutment angle whose apex is on the outside of a closed plane; a plurality of overlap support panels with each disposed and formed to have an angle which fits over said abutment angle of a different pair of adjacent wall panels; metal ring means formed and disposed to fit around the periphery of said plurality of said overlap support panels; a plurality of securing means formed and fitted through said metal ring, through said overlap support panels and through said wall panels whereby said wall panels and said overlap support panels are held in place to form said hot zone chamber.

2. Hot zone chamber wall arrangement according to claim 1 wherein said securing means are formed so that portions thereof can be readily removed to permit the repair and replacement of said wall panels and said overlap support panels without having to deal with all of said security means and support panels.

3. Hot zone chamber wall for use with a vacuum furnace according to claim 1 wherein each of said overlap support panels has thickness, depth, and width dimensions and each overlap support panel lies in abutment to an adjacent overlap support panel along its depth dimension and, each, along with an adjacent overlap support panel overlaps a common wall panel.

4. Hot zone chamber wall for use with a vacuum furnace according to claim 3 wherein each overlap support panel lies in abutment with an adjacent support panel.

5. Hot zone chamber wall for use with a vacuum furnace according to claim 1 wherein there is further included additional overlap support members each of which overlaps the abutting ends of two abutting adjacent overlap support panels.

6. Hot zone chamber wall for use with a vacuum furnace according to claim 1 wherein there are further apertures formed in said wall members and said overlap support members whereby nozzle means may be inserted therein to pass inert gases into the center of said heating means.

* * * * *